US006918344B2

(12) United States Patent
Ebata et al.

(10) Patent No.: US 6,918,344 B2
(45) Date of Patent: Jul. 19, 2005

(54) THREADING DEVICE OF SEWING MACHINE

(75) Inventors: Yoshikazu Ebata, Tokyo (JP); Tamotsu Nakagawa, Tokyo (JP); Koshiro Omiya, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 40 days.

(21) Appl. No.: 10/980,050

(22) Filed: Nov. 3, 2004

(65) Prior Publication Data

US 2005/0115479 A1 Jun. 2, 2005

(30) Foreign Application Priority Data

Nov. 28, 2003 (JP) ..... 2003-400895
Nov. 28, 2003 (JP) ..... 2003-400896

(51) Int. Cl.[7] ..... D05B 87/02
(52) U.S. Cl. ..... 112/225
(58) Field of Search ..... 112/225, 224, 112/302, 470.01; 223/99

(56) References Cited

U.S. PATENT DOCUMENTS 6,742,466 B2 * 6/2004 Sano et al. ..... 112/470.01
6,814,016 B2 * 11/2004 Hori ..... 112/225

* cited by examiner

*Primary Examiner*—Peter Nerbun
(74) *Attorney, Agent, or Firm*—Nields & Lemack

(57) ABSTRACT

A threading device of sewing machine is disclosed, wherein the upper thread extended from a thread supply mounted on a sewing machine body may be easily and smoothly guided into engagement with a thread holder simultaneously when the threading device is operated to pass the upper thread through the eye of needle attached to the lower end of needle bar, the thread holder being arranged between the thread supply and the needle. The threading device comprises a vertically movable needle bar 16 having a needle attached to the lower end thereof, the needle having a needle eye, a needle bar support 1 for supporting the needle bar 16 such that the same may be vertically movable, a thread holder 20 mounted to the lower end of the needle bar 16, a threading member $A_1$ having a thread engaging portion 5 and a threading hook 4*b*, a threading shaft 2 for having the threading member $A_1$ secured to the lower end thereof, an operating section C for vertically moving and axially rotating the threading shaft 2 to pass the upper thread n through the needle eye 17*a*, the threading member $A_1$ being so formed as to provide the thread engaging portion 5 for guiding the upper thread to the needle eye 17*a*, the needle holder 20 being formed with a groove 20*b* for holding the upper thread n, the groove 20*b* having an opening 20*a* at which the upper thread n is guided into the groove 20*b* from the rear side of the thread holder 20 while the thread engaging portion 5 is moved down with the upper thread n which is to be passed through the needle eye 17*a*.

12 Claims, 10 Drawing Sheets

THREADING DEVICE OF SEWING MACHINE

BACKGROUND OF THE INVENTION

The present invention relates to a threading device of sewing machine, and more particularly relates to a threading device for guiding the upper thread smoothly and exactly into engagement with a thread holder while the threading device is operated to pass the upper thread through the needle eye of a machine needle, the upper thread being extended from a thread supply provided on the sewing machine and thread holder being provided to hold the upper thread between the thread supply and the machine needle.

So far, many inventions have been made in connection with a threading device of sewing machine. According to the conventional threading device, a threading shaft is vertically moved down along a guide groove in association with downward movement of an operating member and is stopped at a place where there is a needle eye. With further movement of the operating member, the threading shaft is axially rotated.

In association with the axial rotation of the threading shaft, a threading hook is moved to pass through the needle eye toward the user from the rear side of the needle. Then the user hangs the upper thread onto the threading hook, the upper thread extending from a thread supply provided on the sewing machine.

With release of the operating member or by moving up the operating member, the threading shaft is moved up and the threading hook is pulled out of the needle eye while the upper thread is passed through the needle eye. Thus the threading operation is finished. In this connection, it is general that the thread holder is mounted to the needle bar to hold the upper thread between the thread supply and the needle. It is also general that the upper thread is manually hung onto the thread holder before the upper thread is passed through the needle eye. However, in fact, it is considerably difficult to manually hang the upper thread onto the thread holder. Moreover, the user may often forget to hang the upper thread onto the thread holder. A device for solving such problem is disclosed in the Japanese patent application laid open Hei 9-192381.

However, the device disclosed in the Japanese patent application is extremely complex with many parts required. The device further requires high precision in assembling the parts, but is poor in endurance.

According to the device disclosed in the Japanese patent application, with release of the operating member 25 from pressure, the threading hook 8*a* is pulled out of the needle eye 12*a*. Then the thread which is caught by the threading hook 8*a* may be passed through the needle eye 12*a* in a form of loop. However, as the threading hook 8*a* is moved up, the threading hook 8*a* often fails to hold the thread loop which is not sufficiently tensed and may get out of the threading hook 8*a*. The thread loop freed from the threading hook 8*a* may be often disengaged from the needle eye 12*a* due to some shock or impact accidentally produced or by some mistake of the user.

SUMMARY OF THE INVENTION

It is, therefore, a principal object of the invention to provide a threading device of sewing machine which may be easily operated to guide the upper thread into engagement with a thread holder in the process of needle threading operation.

It is another object of the invention to provide a threading device of sewing machine which is simple in structure and smooth in operation.

It is still another object of the invention to sufficiently enlarge a thread loop which is passed through the needle eye by a threading hook while the upper thread is held by a thread engaging portion which is so designed as to release the upper thread when the thread loop comes to a predetermined size.

The threading device of sewing machine comprises a needle bar having a needle attached at the lower end thereof, the needle having a needle eye; a needle bar support for supporting the needle bar such that the needle bar may be vertically movable; a thread holder provided at the lower end of the needle bar support for holding an upper thread which is extended from a thread supply mounted on the sewing machine body; a threading member having a swing center at one end thereof and swingingly movable around the swing center, the threading member having a threading hook provided at a free end thereof; a threading shaft for holding the threading member at the lower end thereof; an operating member for vertically moving and axially rotating the threading shaft to pass the upper thread through the needle eye.

Further, the threading member includes a thread engaging portion for holding the upper thread as is engaged thereto. The thread holder is formed with an opening for receiving the upper thread threat while the threading member is moved down. The thread engaging portion has a vertically extended guide wall for guiding the upper thread, the guide wall having outer and inner lateral end sides, the outer lateral end side being located at the fee end of the guide wall and the inner lateral end side being located in the neighborhood of the swing center of the guide wall, the guide wall further having a swelled protrusion formed on the rear surface thereof, the swelled protrusion extending progressively lower from the outer lateral end side to the inner lateral end side, wherein the upper thread is guided from the outer lateral end side to the rear surface of the guide wall and pulled out to the front surface of the guide wall around the inner lateral end side, the upper thread being moved down at said inner lateral end side as the guide wall is moved up.

According to the invention, the upper thread may be smoothly and exactly guided into engagement with the thread holder simultaneously when the upper thread is passed through the needle eye. The threading device of the invention is simple in structure and is not an obstacle to the other parts of sewing machine. The threading device includes a thread guide wall having a lower end side extending progressively lower from the lateral free end side to the swing center of the thread guide wall such that the upper thread may be guided into the upper guide.

The upper thread is passed through the needle eye in a form of loop which is progressively enlarged as the threading hook is moved up. The thread loop may be smoothly disengaged from the threading hook when the threading loop becomes a predetermined size. Further the swelled protrusion is extended along the lower end side of the thread guide wall and is progressively reduced from the lateral free end side to the swing center of the thread guide wall so that the threading operation may be smoothly and exactly performed.

(a) is a perspective view of the threading device.

(b) is an exploded perspective view of the parts of the threading device, particularly showing a needle bar support and a fixed guide.

(c) is an exploded perspective view of the parts of the threading device, particularly showing an operating member and a threading member.

FIG. 3

(a) is a perspective view of a threading member of the threading device.

(b) is a perspective view of an essential part of the invention including a needle and a thread holder.

Figure 4:
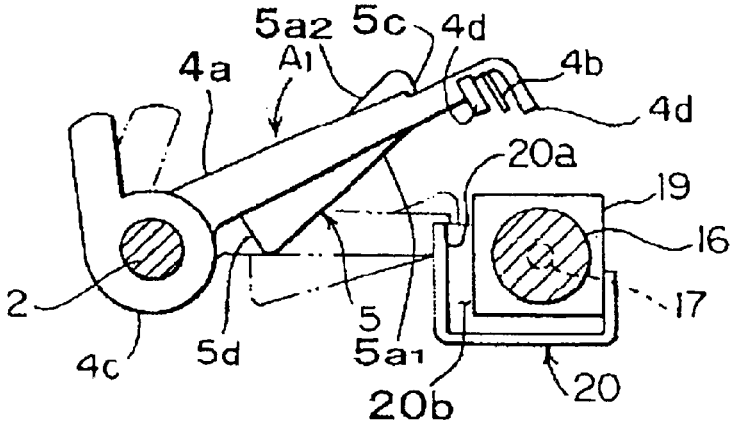

FIG. 4 is a plan elevational view of the threading member and the thread holder shown in a specific positional relation.

FIG. 5

(a)is a front elevational view of the threading member.

(b)is a side elevational view of the threading member shown in vertical section.

FIG. 6

(a)is a rear lavational view of the threading member.

(b)is a perspective view of an essential part of the threading member.

FIG. 7

Figure 6A:
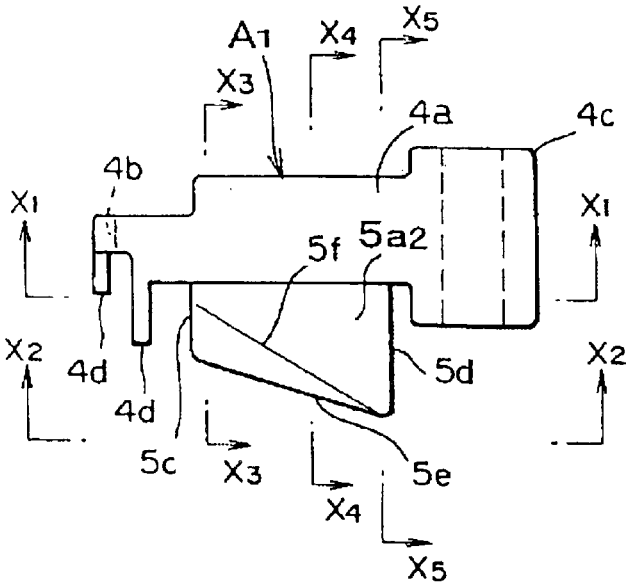
Figure 6B:
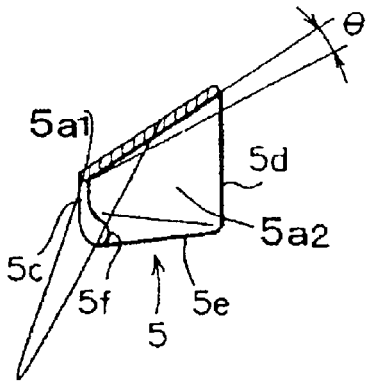

(a) is a plan elevational view of the threading member of FIG. 6(*a*) partly shown in section and taken along the arrows X1—X1.

(b) is a plan elevational view of the threading member of FIG. 6(*a*) taken along the arrows X2—X2.

FIG. 8

(a) is a sectional view of the threading member of FIG. 6(*a*) taken along the arrows X3—X3.

(b) is a sectional view of the threading member of FIG. 6(*a*) taken along the arrows X4—X4.

(c) is a sectional view of the threading member of FIG. 6(*a*) taken along the arrows X5—X5.

Figure 9:
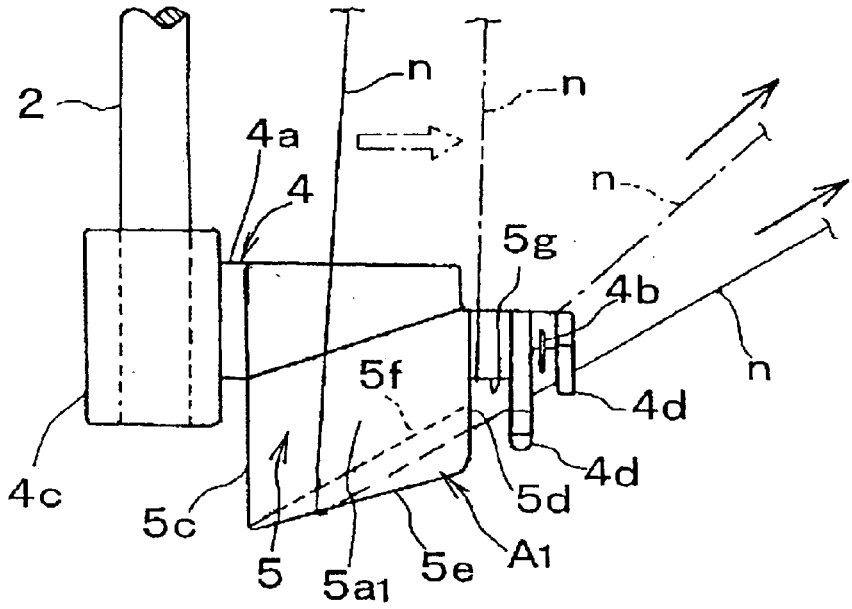

FIG. 9 is a perspective view of the threading member showing the upper thread led along a thread engaging portion into an upper guide.

FIG. 10

(a) is a perspective view of another type of the thread engaging portion.

(b) is a front elevational view of another type of the thread engaging portion.

FIG. 11

(a) is a perspective view of the threading device showing the upper thread guided around the thread engaging portion.

(b) is a front elevational view of (a).

(c) is a perspective view of the threading device showing the upper thread brought into engagement with the thread engaging portion.

(d) is a perspective view of the threading device showing an operating member moved down to move the upper thread toward the opened entrance of the thread holder.

(e) is a perspective view of the threading device showing the upper thread brought into engagement with a threading hook which is passed through the eye of the needle.

Figure 12:
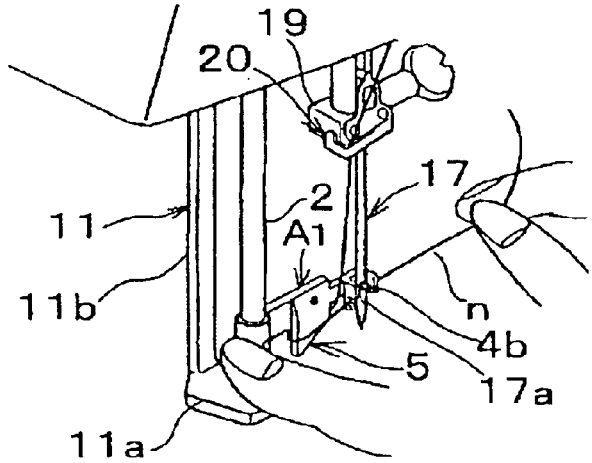

FIG. 12 is a perspective view of the threading device showing the upper thread brought into engagement with the threading hook which is passed through the eye of the needle.

Figure 13:
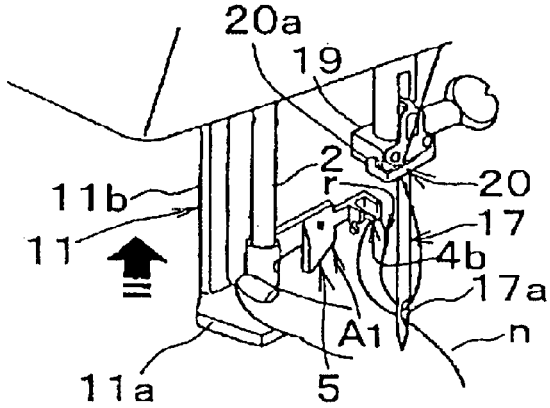

FIG. 13 is a perspective view of the threading device showing the upper thread passed through the needle eye as the operating member is released.

Figure 14:
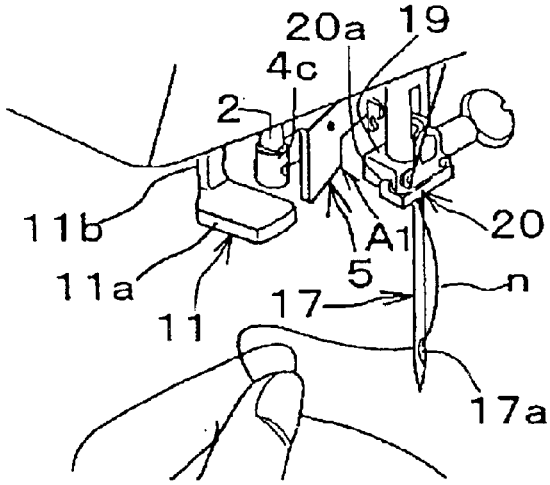
Figure 15A:
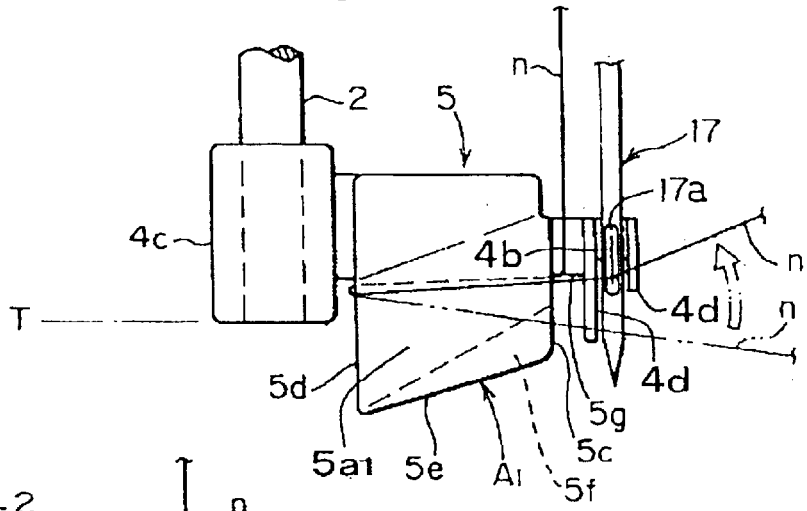
Figure 15B:
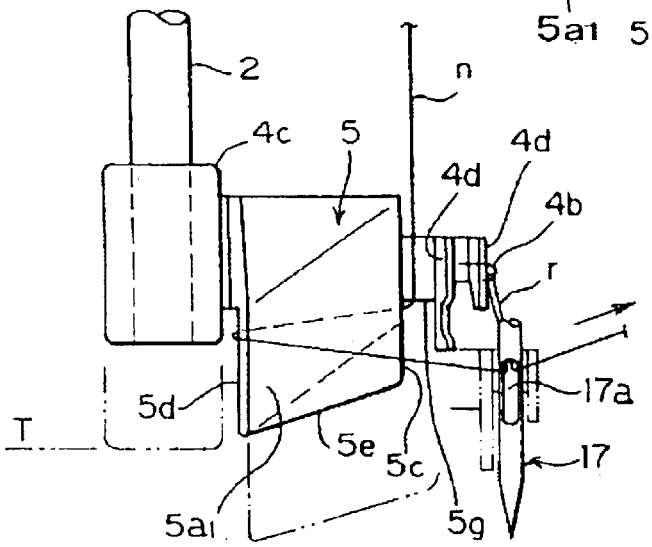
Figure 15C:
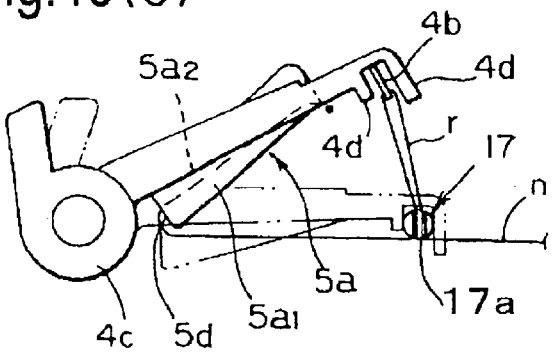
Figure 15D:
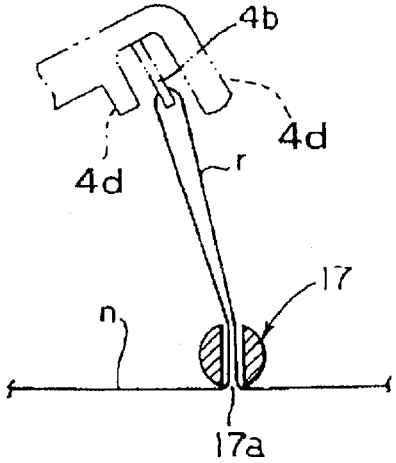
Figure 16A:
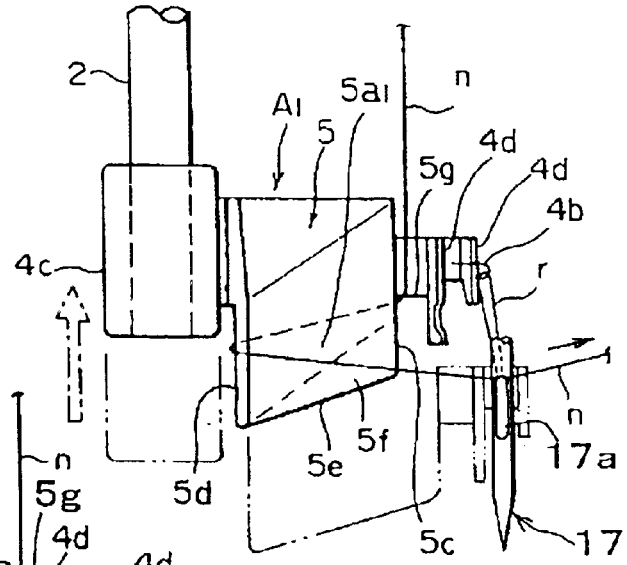
Figure 16B:
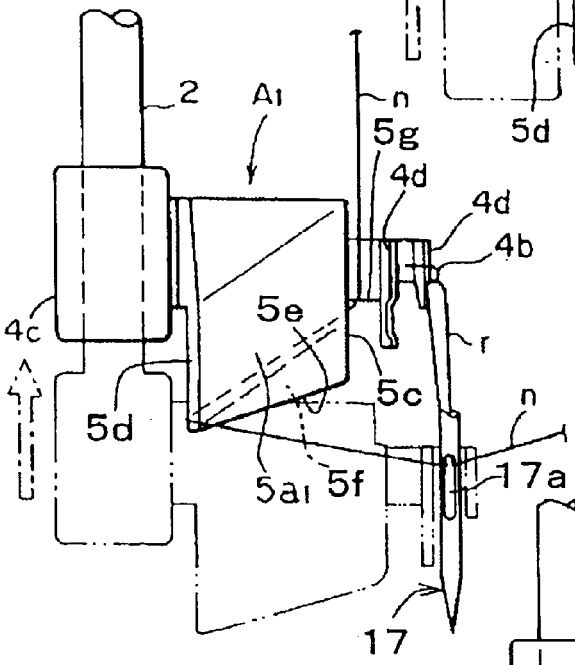
Figure 16C:
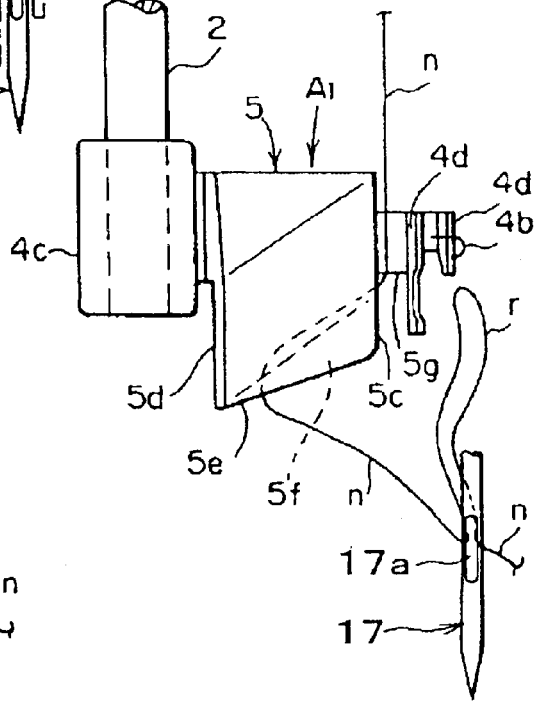
Figure 16D:
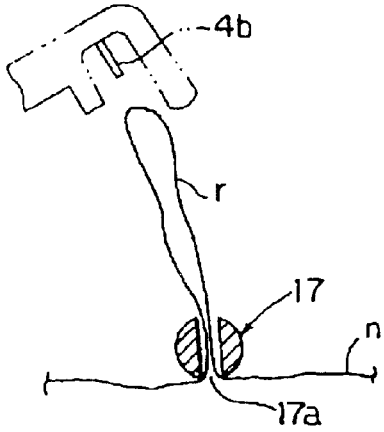

FIG. 14 is a perspective view of the threading device showing the threading operation finished.

FIG. 15

(a) is a front elevational view of the essential part of the threading device showing the upper thread brought into engagement with the threading hook.

(b) is a front elevational view of the essential part of the threading device showing the condition wherein the threading hook is pulled out of the needle eye and the upper thread is on the way to be disengaged from the thread engaging portion.

(c) is an enlarged plan elevational view of the essential part of the threading device partly shown in section showing the upper thread disengaged from the thread engaging portion.

(d) is an enlarged plan view of the essential part of the threading device partly shown in section showing the upper thread passed through the needle eye in a form of loop.

FIG. 16

(a) is a front elevational view of the essential part of the threading device showing the condition wherein the thread loop is progressively enlarged as is pulled through the needle eye.

(b) is a front elevational view of the essential part of the threading device showing the upper thread moved to the lower end of the thread engaging portion.

(c) is a front elevational view of the essential part of the threading device showing the upper thread disengaged from the thread engaging portion.

(d) is an enlarged view of the essential part of (c).

DETAILED DESCRIPTION OF THE PREFERRED EMBODIMENTS

Figure 1:
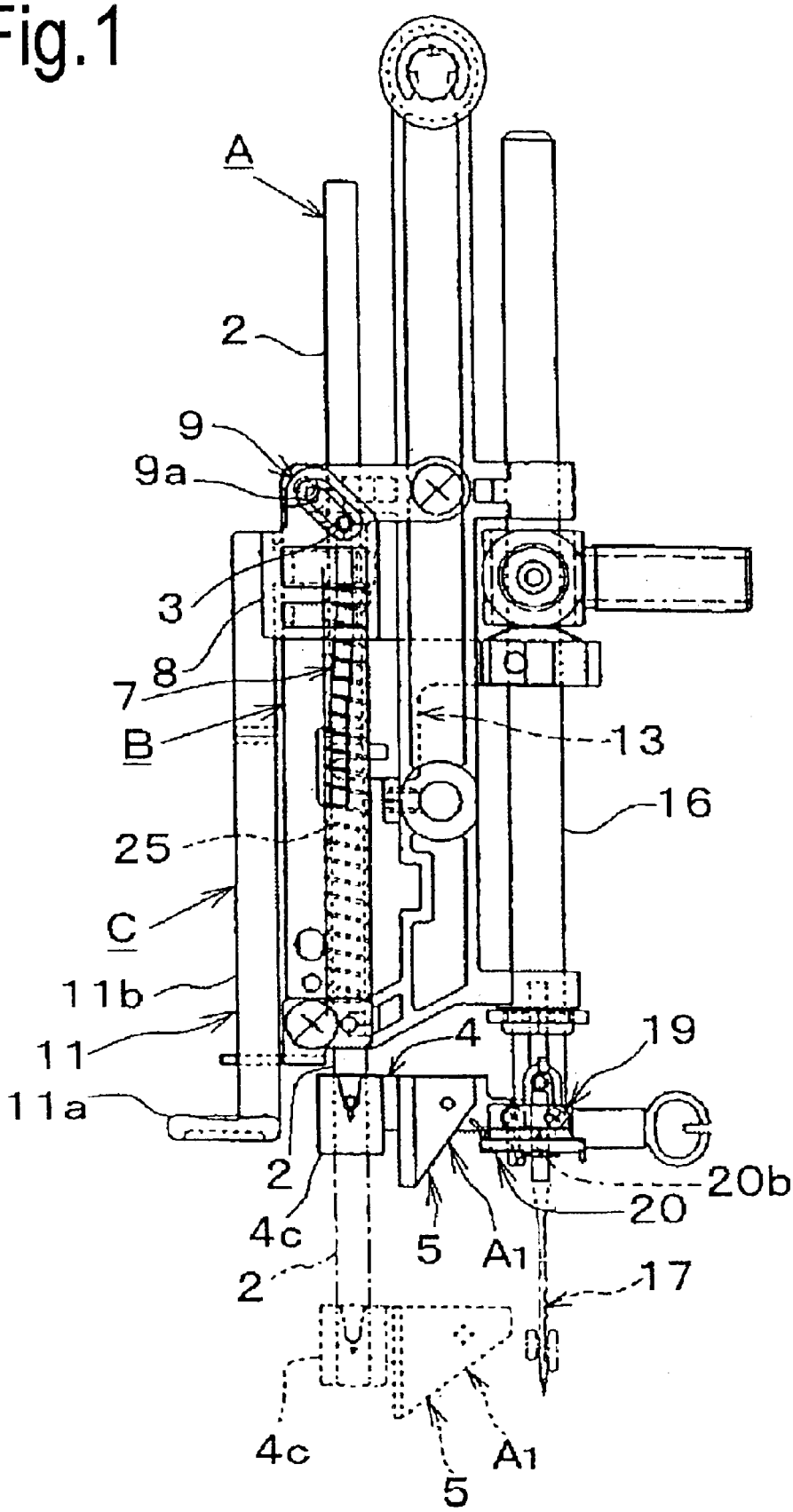
FIG. 1 is a front elevational view of a threading device of sewing machine according to the invention.
Figure 2A:
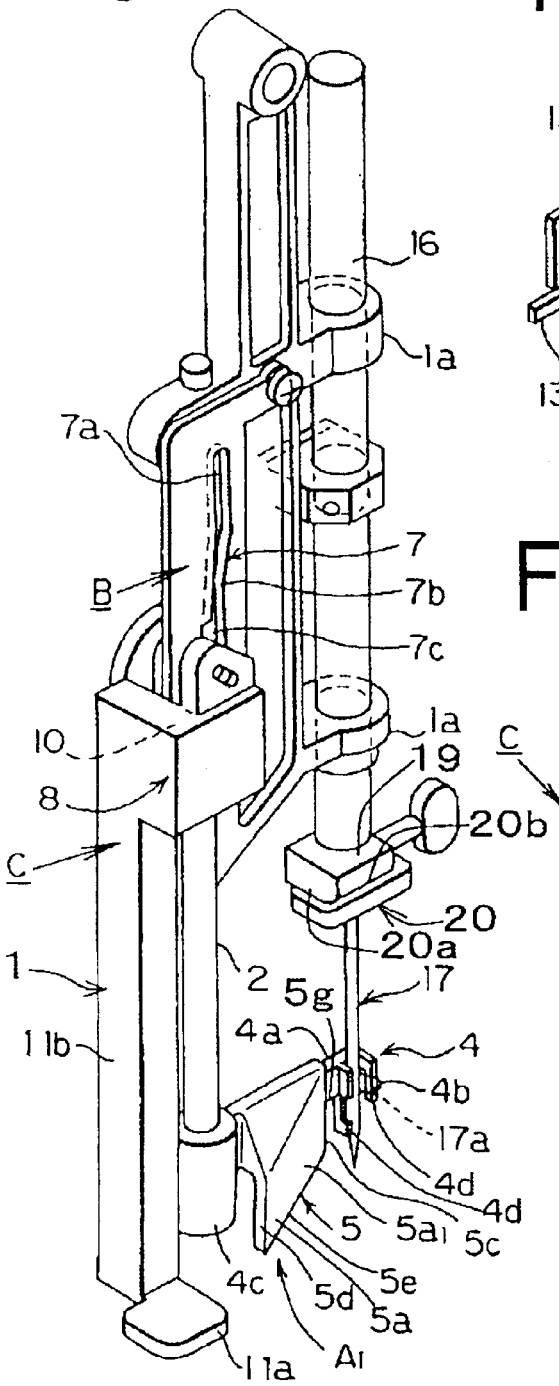
FIG. 2
Figure 2B:
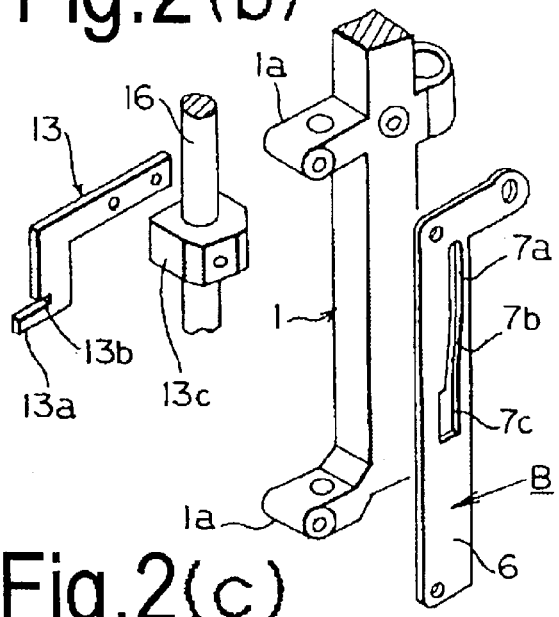
Figure 2C:
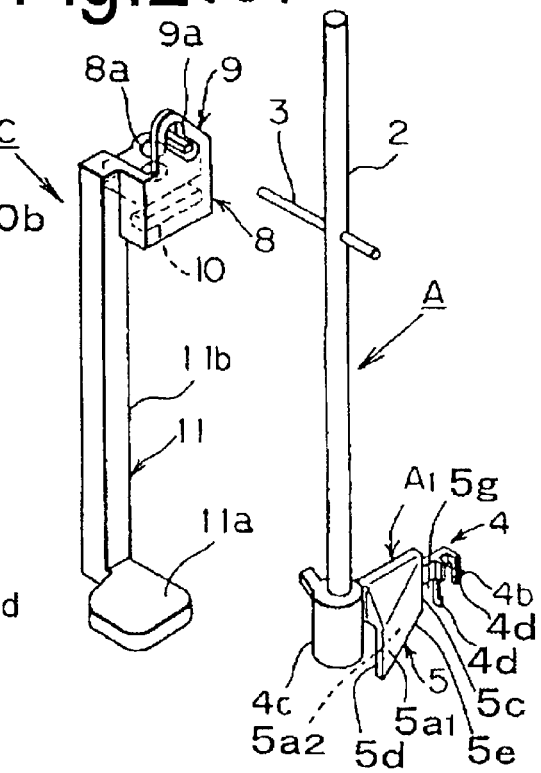

The invention will be described in reference to the embodiments as shown in the attached drawings. The invention is essentially composed of a threading shaft section A, a fixed guide section B and an operating section C as shown in FIGS. 1 and 2. These sections are mounted to a needle bar support 1. The needle bar support 1 is so structured as to support a needle bar 16 such that the same may be slidingly moved in vertical direction. The needle bar support 1 is mounted to a sewing machine such that the same may be swingingly movable across the direction in which a cloth is transported to be stitched. The needle bar support 1 is formed with upper and lower holder 1*a*, 1*a* for holding the needle bar 16 such that the same may be slidingly moved in vertical direction.

The needle bar 16 is provided with a thread holder 20 secured to the underside of a needle holder 19 of square block which is secured to the lower end of the needle bar 16. The thread holder 20 may be a plate which is made of metal, synthetic resin or the like. The thread holder 20 has a front side partly bent to extend rearward. The thread holder 20 is formed with a groove 20*b* having an opening 20*a* for receiving a thread thereat, the thread being guided along the rearward extension into the groove 20*b*.

The thread shaft section A is, as shown in FIG. 2(*c*), composed of a threading shaft 2, a guide pin 3 and a threading member $A_1$. The guide pin 3 extends laterally of the threading shaft 2 passing therethrough at the upper part, about one third of the length thereof. The guide pin 3 is in engagement with a movable guide 9 of the operating section C and is vertically moved so that the threading shaft 2 may be vertically moved as will be described in detail hereinlater.

Figure 3A:
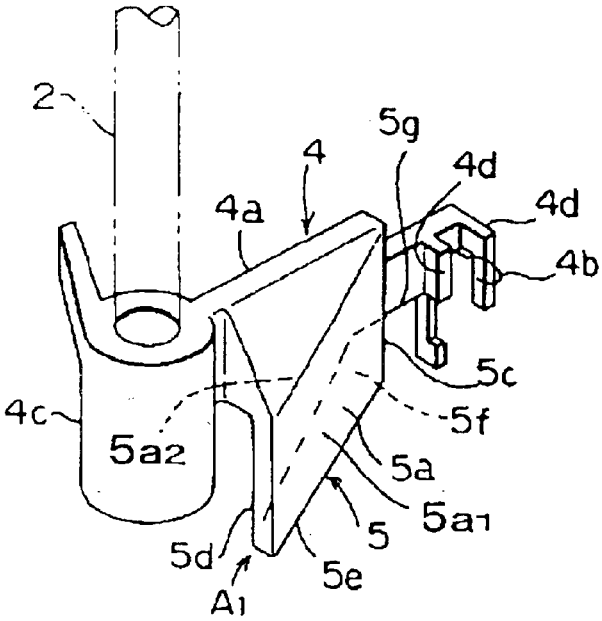
Figure 3B:
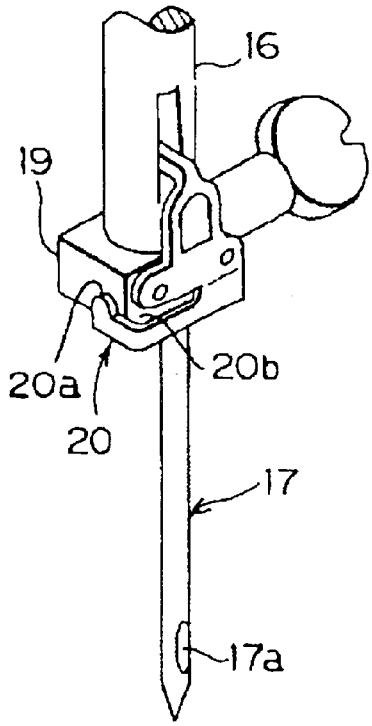
Figure 5A:
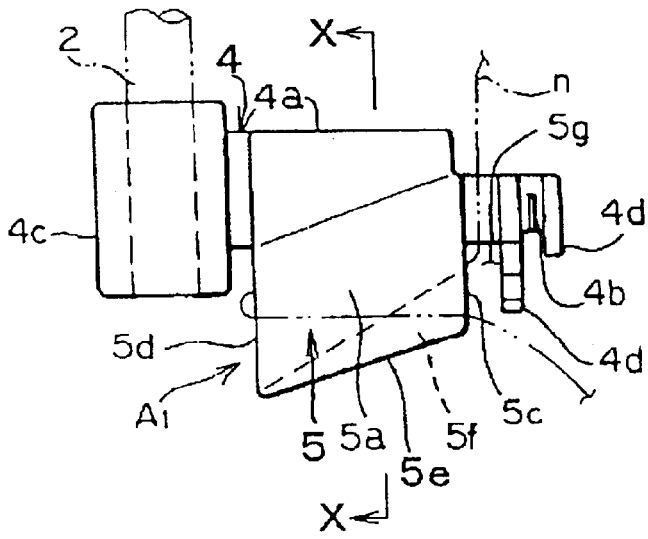
Figure 5B:
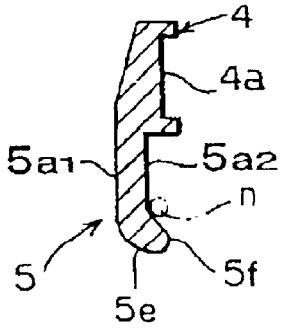

The threading member $A_1$ is, as shown in FIG. 3(*a*) and FIG. 5, formed to have a threading portion 4 and a thread engaging portion 5. The threading portion 4 includes a swingable arm 4*a*, a threading hook 4*b* provided at one end of the swingable arm 4*a* and a cylindrical base 4*c* which is a swing center provided at the opposite end of the swingable arm 4*a* and secured to the lower end of the threading shaft 2 so that the threading portion 4 may be axially rotated as the threading shaft 2 is axially rotated.

The threading hook 4*b* is provided at the free end of the swingable arm 4*a* and is of a size which may be freely inserted into and out of the eye 17*a* of a needle which is attached to the lower end of the needle bar 16. Namely as shown in FIG. 4, the threading hook 4*b* may be freely inserted into and out of the needle eye 17*a* when the swingable arm 4*a* is swingingly moved in the horizontal plane while the threading shaft 2 is axially rotated. The swingable arm 4*a* is further formed with a pair of guides 4*d*, 4*d* on both sides of the threading hook 4*b* so that the guides 4*d*, 4*d* may be moved to embrace the needle when the swingable arm 4*a* is swingingly moved, thereby to guide the threading hook 4*b* to the needle eye 17*b*.

The thread engaging portion 5 is formed in one body with the swingable arm 4*a* as shown in FIG. 3(*a*) and FIG. 5. The thread engaging portion 5 is formed in a plate of proper thickness and has laterally opposite outer and inner end sides 5*c*, 5*d* which are extended substantially in parallel with each other. The thread engaging portion 5 is formed in a shape of trapezoid having an inclined lower end side 5*e*. The thread engaging portion 5 has a wall 5*a* for guiding the upper thread. The thread guide wall 5*a* has a front surface $5a_1$ and a rear surface $5a_2$. The outer lateral end side 5*c* of the wall 5*a* which is located in the neighborhood of the free end of the swingable arm 4*a* is vertically shorter than the opposite inner lateral end side 5*d* which is located in the neighborhood of the base 4*c* of the swingable arm 4*a* which is the swing center of the swingable arm 4*a*. The lower end side 5*e* of the trapezoidal thread engaging portion 5 is extended as inclined progressively lower to the inner lateral end side 5*d* from the outer lateral end side 5*c*.

Figure 7A:
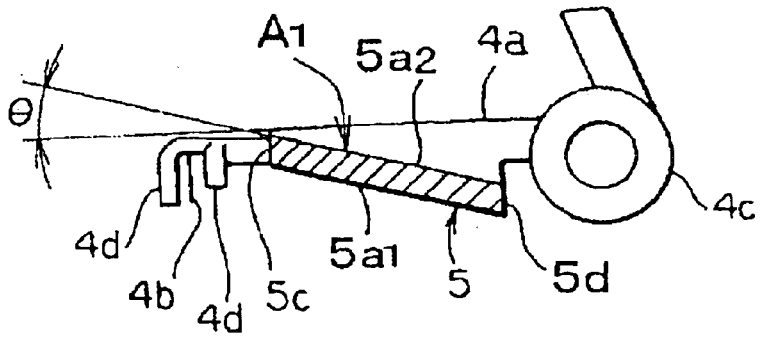
Figure 7B:
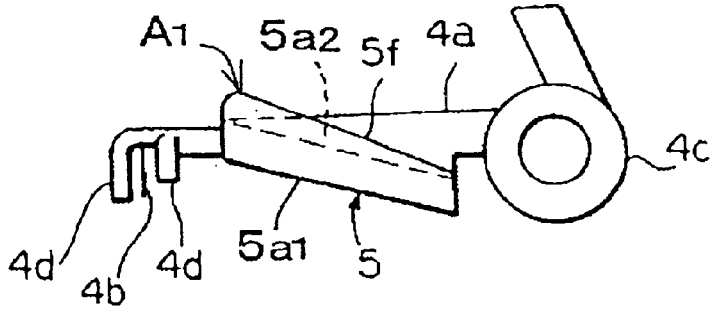

Further, the rear surface $5a_2$ of the thread engaging portion 5 is properly inclined at angle θ with respect to the longitudinal extension of the swingable arm 4*a* as shown in FIGS. 6 and 7(*a*). Precisely, the rear surface $5a_2$ is coplanar with the swingable arm 4*a* at the free end thereof, but is extended progressively far from the longitudinal extension of the swingable arm 4*a* from the lateral end side 5*c* to the lateral end side 5*d* of the thread engaging portion 5 in the manner that the thread engaging portion 5 is progressively protruded to the front side.

Figure 8A:
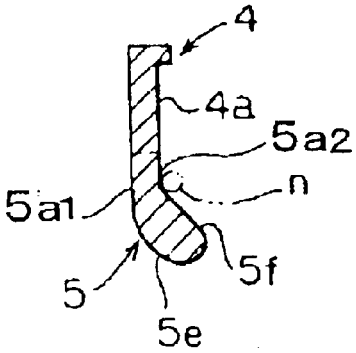
Figure 8B:
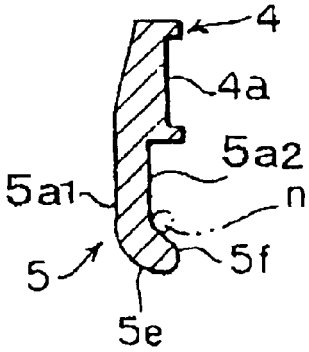
Figure 8C:
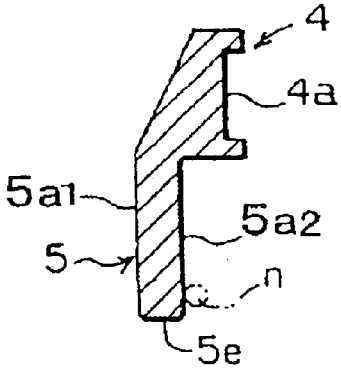

The lower end side 5*e* of the thread engaging portion 5 is swelled out from the vertical rear surface $5a_2$ and is formed as a protrusion 5*f* for holding the upper thread as shown in FIG. 5(*b*) and in FIGS. 6 and 8(*a*), (*b*). The swell of the upper thread holding protrusion 5*f* is progressively enlarged from the swing center 4*c* to the free end of the swingable arm 4*a* with a smooth and arced surface being provided between the rear surface $5a_2$ and the upper thread holding protrusion 5*f* so that the upper thread n may be smoothly disengaged from the thread engaging portion 5. Further, since the lower end side 5*e* of the thread engaging portion 5 is extended progressively upper from the swing center side to the free end of the threading arm 4*a* as shown in FIG. 9, the upper thread n may be smoothly slid into an upper thread guide 5*g* as is pulled by the user toward the free end of the swingable arm 4*a* along the lower end side 5*e* of the thread engaging portion 5. The thread guide 5*g* is in a shape of a gate provided with a lower opening and formed with the lateral end side 5*c* of the thread engaging portion 5, the end part of the swingable arm 4*a* and the guide 4*d* which is one of the two guides 4*d* for guiding the threading hook 4*b* to the needle eye 17*b*. The upper thread n is slid into the upper thread guide 5*g* and thus may be extended to the side of the rear surface $5a_2$ of the thread engaging portion 5.

Figure 10:
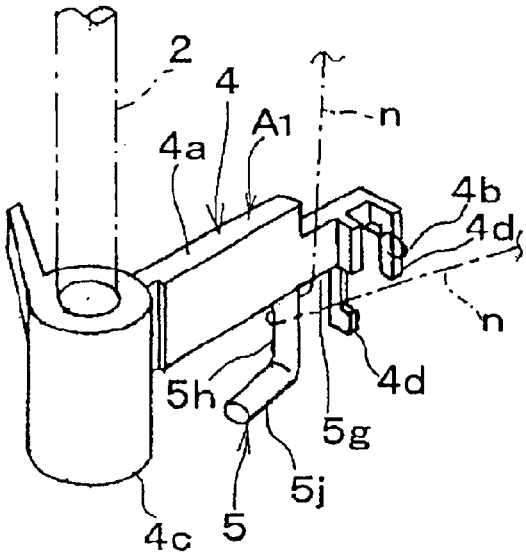
Figure 10:
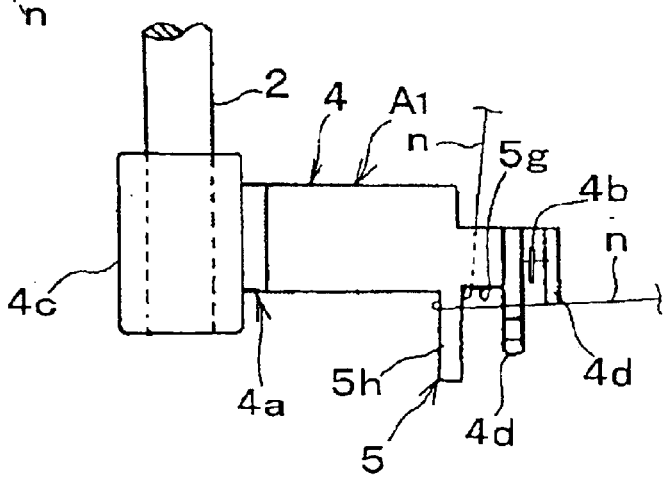
Figure 11A:
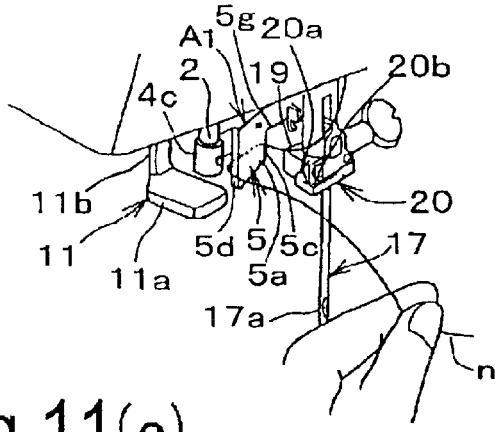
Figure 11B:
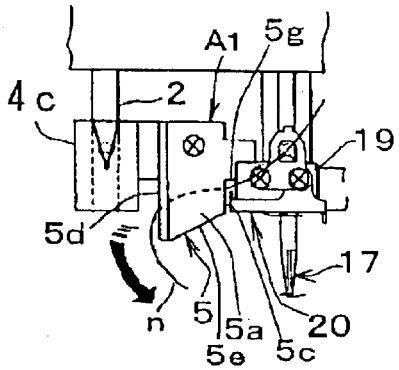
Figure 11C:
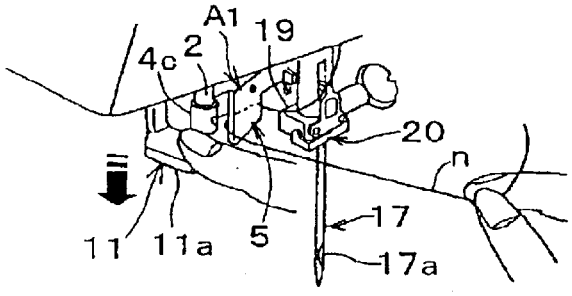
Figure 11D:
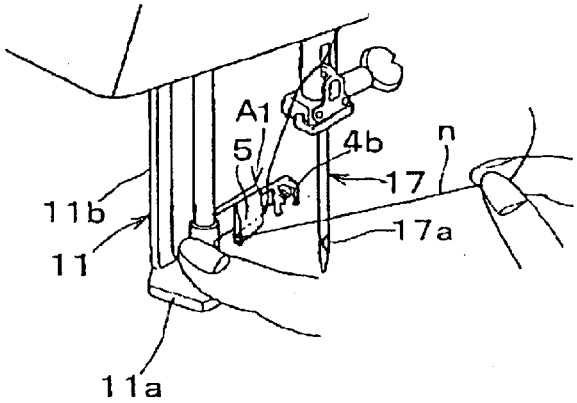
Figure 11E:
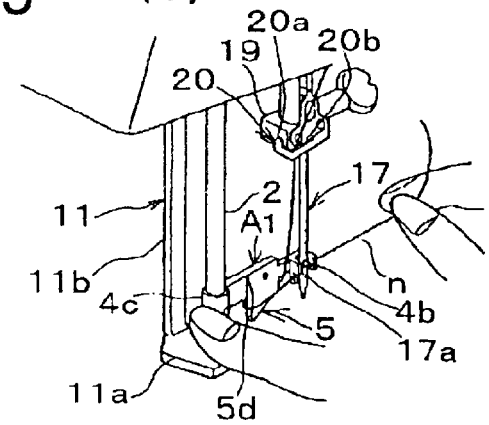

As mentioned hereinbefore, with the rear surface $5a_2$ of the thread engaging portion 5 being inclined with respect to the vertical extension of the swingable arm 4*a*, the upper thread n, which is guided to the surface $5a_2$ of the thread engaging portion 5 from the free end side of the swingable arm 4*a*, may be easily pulled out to the front surface $5a_1$ of the thread engaging portion 5 around the lateral end side 5*d* thereof which is adjacent to the side of the swing center 4*c* of the swingable arm 4*a* without excessive load which may be otherwise applied to the upper thread n. FIG. 10(*a*) shows another type of the thread engaging portion 5 which is in a form of generally L-shaped guide of vertically extending shaft portion 5*h* and laterally extending shaft portion 5*j* which is bent to extend toward the swing center 4*c* of the swingable arm 4*a*. The upper guide 5*g* is formed with the vertically extending shaft portion 5*h*, the inner one of the hook guides 4*d*,4*d* and the lower end side of the swingable arm 4*a* between the vertically extending shaft portion 5*h* and the inner hook guide 4*d*. FIG. 10(*b*) shows still another type of the thread engaging portion 5 which is formed simply with a vertically extending shaft portion 5*h*.

As particularly shown in FIG. 2(*c*), the guide pin 3 and the swingable arm 4*a* are mounted to the threading shaft 2 with a predetermined angle provided therebetween in a horizontal plane. The angle is determined by a rotation angle of the threading shaft 2 which is required for threading operation and which is regulated by cooperation of the guide pin 3 and the guide groove 7 of the fixed guide section B as will be described in detail hereinlater. A coiled spring 25 is arranged around the threading shaft 2 between the guide pin 3 and the lower holder 1*a* of the needle bar support 1 and normally urges the threading shaft 2 in the upper direction. The threading member $A_1$ mounted to the lower end of the threading shaft 2 is, therefore, normally held in the upper inoperative position.

The fixed guide section B is, as shown in FIG. 2(*a*), (*b*), composed of a vertically extending guide plate 6 formed with a vertivally extending guide groove 7 which is in engagement with one end side of the guide pin 3 of the threading shaft section A. The guide groove 7 is provided with a first region where the guide pin 3 may be vertically moved and a second region at the lower end of the first region where the guide pin 3 is moved to axially rotate the threading shaft 2. Precisely, the guide groove 7 is formed with an upper vertically extending groove 7*a*, a middle groove 7*b* extending as slightly inclined with respect to the upper groove 7*a* and a lower set groove 7*c* which is enlarged in the inclination of the middle groove 7*b*. The upper vertically extending groove 7*a* is designed to vertically guide the guide pin 3 in the condition that the same may not be rotated in the horizontal plane. The middle groove 7*b* is designed to rotate the guide pin 3 as the same is vertically moved.

The middle groove 7*b* is so designed as to enable the guide pin 3 to operate the threading hook 4*b* to avoid the constituent members of sewing machine as the same is vertically moved. The lower set groove 7*c* is so designed as to axially rotate the swingable arm 4*a* of the threading member $A_1$ to a predetermined position through the guide pin 3. Namely, the guide groove 7 is designed to vertically guide the guide pin 3 in the lower direction to axially rotate the threading shaft 2, thereby to axially rotate the threading member $A_1$ such that the threading hook 4*b* of the threading member $A_1$ may be moved toward the eye 17*a* of the needle 17 which is attached to the lower end of the needle bar 16 by means of the needle holder 19. The guide pin 3 is rotated in the horizontal plane in the middle groove 7*b*, and therefore the threading shaft 2 is axially rotated. When the guide pin 3 comes into the lower set groove 7*c*, the threading shaft 2 is further rotated to insert the threading hook 4*b* through the eye 17*a* of the needle 17.

More precisely, as shown in FIG. 2(*a*), (*b*), the guide pin 3 mounted to the threading shaft 2 is horizontally rotated as the same is moved along the inclined guide groove 7*b*. The rotation of the guide pin 3 is transmitted to the threading shaft 2. The threading shaft 2 is then axially rotated and therefore, the swingable arm 4*a*, which is mounted to the lower end of the threading shaft 2, is axially rotated.

As shown in FIG. 2(*b*), a positioning member 13 is mounted to the needle bar 16 (or to the needle bar holder 1). The positioning member 13 is so positioned as to engage the guide pin 3 when the threading member $A_1$ is moved down and comes to a position corresponding to the position where the needle eye 17*a* is located. Namely when the threading shaft 2 is moved down and the guide pin 3 comes to engage the positioning member 13, the threading shaft 2 is stopped and is axially rotated. The positioning member 13 is composed of a block 13*c* secured to the needle bar 16 and a stopper member which is fixed to the block 13*c*. The stopper member is substantially of L-shape having a horizontally extending portion and a downwardly extending portion. The downwardly extending portion has an abutment 13*a* formed at the lower end thereof. The abutment 13*a* is horizontally extended and the upper side is extended into a recess 13 which is provided to receive the guide pi 13.

The abutment 13*a* and the recess 13*b* of the positioning member 13 are provided to enable the guide pin 3 to decide the position where the threading hook 4*b* may be inserted through the eye 17*a* of the needle 17 and simultaneously to prevent the vertical movement of threading hook 4*b* while same is inserted into and out of the needle eye 17*a*, thereby to prevent a damage of the threading hook 4*b* and the needle 17. The positioning member 13 is fixed to an optimum position of the needle bar 16 by a screw or the like such that the recess 13*c* may decide the position where the lower movement of the guide pin 3 is stopped in connection with the vertical standstill position of the needle eye 17*a* which is variable.

As shown in FIGS. 1 and 2, the operating section C includes an elongated operating member 11 having a base 8 formed at the upper end thereof and a knob 11*a* formed at the lower end thereof, a guide 9 in a form of slot 9*a* arranged as adjacent the base 8 and a guide groove 10 which is formed between the base 8 and the guide 9. The base 8 is formed with a vertical hole 8*a*. The threading shaft 2 is arranged as extended through the vertical hole 8*a* such that the operating section C may be slidingly moved relative to the threading shaft 2.

The guide groove 10 of the operating section C is adapted to receive the guide plate 6 of the fixed guide section B such that the operating section C may be vertically moved along the guide plate 6.

As mentioned hereinbefore, the coiled spring 25 arranged around the threading shaft 2 as shown in FIG. 1. The coiled spring 25 has the upper end pressed against the lower end of the base 8 of the operating section C and has the lower end pressed against the lower needle bar holder 1*a* of the needle bar support 1. Thus the coiled spring 25 normally urges the operating section C in the upper direction.

As shown in FIG. 2(*c*), the slot 9*a* of the operating section C is in engagement with the guide pin 3 of the threading shaft 3 as the guide pin 3 is inserted into the slot 9*a* such that the threading section A may be vertically moved as the operating section C is vertically moved. It is, therefore, apparent that the threading shaft 2 is normally urged in the upper direction by the coiled spring 25 together with the operating section C. The slot 9*a* is inclined at a proper angle, preferably at 45°. But the inclined angle is not limited to the value. The slot 9*a* is inclined in the direction opposite to the inclination of the guide grove 7*b*.

With the slot 9*a* being inclined in the direction opposite to the inclination of the guide grove 7*b*, the slot 9*a* is adapted to properly adjust the horizontal rotation speed of the guide pin 3 while the guide pin 3 is moved along the guide groove 7*b*. In care the inclination of the slot 9*a* is steeper, the rotation speed of the guide pin 3 is slower. In case the inclination of the slot 9*a* is more3 gentle, the rotation speed of the guide pin 3 is faster. Namely the axial rotation speed of the threading shaft 2 and the swingable arm 4*a* depends upon the inclined degree of the slot 9*a*. The slot 9*a* may be horizontally formed to rotate the guide pin 3 at a highest speed.

As shown in FIG. 2(*a*),(*c*), the elongated operating member 11 includes a vertical rod 11*b* having the base 8 formed at the upper end thereof and having the knob 11*a* formed at the lower end thereof. The knob 11*a* may be pressed down with a finger to move down the operating rod 11*b* and the threading shaft 2 accordingly. The operating section C is mounted to the fixed guide section B so that the former may be slidingly moved relative to the latter with the guide plate 6 of the fixed guide section B being inserted into the guide groove 10 of the operating section C.

With combination of the constituent elements of the invention, the threading operation will be described. At first, as shown in FIG. 11(*a*),(*b*), the upper thread n, which is extended from the thread supply on the machine body (not shown), is guided to the front side of the threading member $A_1$ at the free end thereof and is guided to the rear surface $5a_2$ of the thread engaging portion 5 toward the swing center 4*c* of the threading member $A_1$. The upper thread n is then pulled out to the front surface $5a_1$ of the thread engaging portion 5 around the lateral end side 5*d* of the thread engaging portion 5 while the upper thread n is slightly strained as is pulled with fingers. Then as shown in FIG. 11(*c*), as the operating rod 11 is moved down against the force of the coiled spring 25 by pressing down the knob 11*a*, the guide pin 3, which is in engagement with the slot 9*a* of the guide 9, is moved down along the guide groove 7 of the guide plate 6. The threading shaft 2 is, therefore, moved down.

As the guide pin 3 comes to engage the positioning member 13, the threading shaft 2 is stopped while the same is axially rotated. The threading member $A_1$ is, therefore, axially rotated and the upper thread n of the upper stream comes near to the opening 20*a* of the groove 20*b* of the thread holder 20 as shown in FIG. 11(*d*).

As the operating rod 11 is further moved down, the threading shaft 2 is moved down and axially rotated through the guide pin 3 which is moved down as guided by the slot 9*a*. The threading member $A_1$ is therefore, further rotated and the upper thread n is inserted into the groove 20*b* of the thread holder 20 as shown in FIG. 12, the upper thread n being guided at the opening 20*a* and along the rearward extension into the groove 20*b*. Simultaneously the threading hook 4*b* of the swingable arm 4*a* comes to a level corresponding to the needle eye 17*a* and is passed through the eye 17*a* of the needle 17 toward the user.

Subsequently, the end of the upper thread n is hung on the threading hook 4*b* and the knob 11*a* is released. The threading shaft 2 is moved up by the coiled spring 25 while the swingable arm 4*a* is rotated in the opposite direction and the threading hook 4*b* is moved out of the needle eye 17*a* away from the user. Thus the upper thread n is passed through the needle eye 17*a* away from the user with the threading hook 4*b* as shown in FIGS. 13 and 14 while the upper thread n remains in engagement with the groove 20*b* of the thread holder 20.

As the threading member $A_1$ is moved up, the upper thread n is progressively disengaged from the thread engaging portion 5, that is, progressively disengaged from the swelled protrusion 5*f* at the lateral end side 5*d* toward the opposite lateral end side 5*c* of the thread engaging portion 5. Since the swell of the protrusion 5*f* is progressively enlaged from the lateral end side 5*d* to the opposite lateral end side 5*c*, the upper thread n may be progressively and smoothly disengaged from the thread engaging portion 5. Therefore, the upper thread n which is received in the groove 20*b* of the thread holder 20, will not be disengaged from the thread holder 20 while the swingable arm 4*a* is moved up.

More precisely, in FIG. 15(*a*), the threading member $A_1$ is located at the lowest position T while the threading hook 4*b* is passed through the needle eye 17*b* toward the user and the upper thread n is hung on the threading hook4*b*. When the operating rod 11 is released, the threading member $A_1$ is moved up while the same is swingingly moved back in the direction opposite to the direction that the swingable arm 4*a* was swingingly moved when the same was moved down.

Further more precisely, the thread engaging portion 5 including the swelled protrusion 5 is so formed that the upper thread n may be extended laterally of the needle 17 on the front side thereof. The upper thread n is guided to extend on the front side of the swingable arm 4*a* at the free end side thereof and is guided into the upper guide 5*g*. The upper thread n is further guided to extend laterally on the rear surface $5a_2$ and is pulled out to the front surface 5*a*, around the lateral end side 5*d* of the thread engaging portion 5. The upper thread n is guided to extend laterally of the needle 17 on the front side thereof. The upper guide 5*g* is, as mentioned hereinbefore, a gate surrounded with the lateral end side 5*c* of the thread engaging portion 5, the swingable arm 4*a* and the inner hook guide 4*d* which is one of the hook guides 4*d*,4*d*. The upper guide 5*g* is provided with the lower opening at which the upper thread n is inserted into the guide 5*g* and is guided along the rear surface $5a_2$ of the thread engaging portion 5.

The upper thread n is guided around the lateral end side 5*d* of the thread engaging portion 5 to the front surface $5a_1$ of the thread engaging portion 5 toward the needle 17. Then the threading member $A_1$ is moved down to the lowest position T where the threading hook 4*b* comes to the level corresponding to the needle eye 17*a*. The end portion of the upper thread n is then held on the guides 4*d*, 4*d* on both sides of the thread hook 4*b* as shown in FIG. 15(*a*). Thus the upper thread n is extended along the line between the guide wall 5*a* of the thread engaging member 5 and the hook guides 4*d*, 4*d*.

As the operating rod 11 is released, the threading member $A_1$ is moved up while the same is rotated in the direction to pull out the threading hook 4*b* from the needle eye 17*a*. The threading hook 4*a* is, therefore, moved in the direction away from the user pulling the upper thread n extended forwardly of the needle eye 17*a*. Thus the upper thread n is passed through the needle eye 17*a* with a loop r formed on the rear side of the needle eye 17*a* as shown in FIG. 15(*c*),(*d*). In this instance, the upper thread n is extended on the guide wall 5*a* of the thread engaging portion 5 between the upper guide 5*g* and the needle eye 17*a*.

As the thread engaging portion 5 is moved up, the upper thread loop r is progressively enlarged. In this instance, the upper thread n is held on the swelled protrusion 5*f* at a lower position on the side of the upper guide 5*g* and is extended around the lateral end side 5*d* of the thread engaging portion 5 to the front surface 5*a*1 as shown in FIG. 15(*b*). The swelled protrusion 5*f* is adapted to hold the upper thread n as the upper thread n is progressively disengaged from the thread engaging portion 5, and helps the thread loop r enlarge on the rear side of the needle 17.

As the thread engaging portion 5 is further moved up, the threading hook 4*b* is moved up accordingly and the thread loop r becomes larger. In this instance, the upper thread n is progressively moved down on the thread engaging portion 5 at the lateral end side 5*d* as shown in FIG. 16 (*a*),(*b*). Actually the upper thread n may be smoothly moved down because the swelled protrusion 5*f* is properly inclined with respect to the front and read surfaces 5*a*1, $5a_2$ of the thread engaging portion 5.

The upper thread n is disengaged from the thread engaging portion at the lower end of the lateral end side 5*d* while the thread loop r comes to be enlarged to a predetermined size. With such disengagement of the upper thread n from the thread engaging portion 5, the upper thread n is suddenly loosened to have the threading hook 4*b* slip out of the thread lop r. Thus the thread engaging portion 5 is moved up to the upper inoperative position. The thread loop r is then completely pulled out of the needle eye 17*a* by the user4 on the rear side of the needle 17. hus the threading operation is finished. Namely, the size of the thread loop r may be determined by the size of the thread engaging portion 5 including the upper thread guide 5*g*, the swelled protrusion 5*f*, the front and rear surfaces 5*a*1, 5*a*2 and the inner lateral end side 5*d* which is vertically extended. The size of the thread loop r may be modified by changing the vertical size of the inner lateral end side 5*d* of the thread engaging portion 5.

The lower end side 5*e* of the thread engaging portion 5 is formed as inclined to be progressively lower to the swing center 4*c* from the free end. The swelled protrusion 5*f* is formed as to extend along the lower end side 5*e*. The upper thread n is progressively disengaged from the thread engaging portion 6 as is guided along the lower end side 5*e* from the swing center 4*c* progressively up to the free end. The upper thread n is smoothly released from the thread engaging portion 5 while the upper thread is passed through the needle eye 17*a*. In the process of threading operation, by means of pressing the upper thread n against the lower end side 5*e* of the thread engaging portion 5 as the upper thread n is guided along the lower end side 5*e*, the upper threads n may be smoothly led into the upper thread guide 5*g*. Further, since the swelled protrusion 5*f* is progressively reduced toward the swing center 4*c* of the thread engaging portion 5 from the free end thereof, the upper thread n may be smoothly disengaged from the swelled protrusion 5*f*.

Regardless of engaging the upper thread to the thread holder of the needle bar, the thread engaging portion 5 is arranged so as to vertically move relative to the thread holder which is located to position the upper thread n on the front side of the needle eye 17*a* while the upper thread is extended as is guided from the thread holder to the threading hook 4*b*. The upper thread n is guided as is extended along the guide wall 5*a* of the thread engaging portion 5 while the upper thread n is held on the upper guide 5*g*. With the thread engaging portion 5 moved down, as the threading hook 4*b* comes to the level corresponding to the needle eye 17*a*, the end portion of upper thread n is put into engagement with the hook guides 4*d*, 4*d*. In this condition, the upper thread n extended on the guide wall 5*a* of the thread engaging portion 5 is positioned between the upper thread guide 5*g* and the hook guides 4*d*, 4*d*. In this instance, provided that the upper thread guide 5*g* is so formed as to be of the same level with the hook guides 4*d*, 4*d*, the upper thread n extended on the guide wall 5*a* of the thread engaging portion 5 is of the same level. Namely the upper thread n is positioned at the same level with the needle eye 17*a*. Thus the vertical position of the upper guide 5*g* and of the hook guides 4*d*, 4*d* determines the exact catch of the upper thread n by the threading hook 4*b*.

With axial rotation of the swingable arm 4*a*, the threading hook 4*b* is moved to pass through the needle hook eye 17*a* and pulls the upper thread n through the needle eye 17*a* in a form of loop r. In this instance, since the vertical position of the thread engaging portion 5 is unchanged, the upper thread n on the guide wall of the thread engaging portion 5 is extended between the upper thread guide 5*g* and the needle eye 17*a*. With upper movement of the thread engaging portion 5, the threading hook 4*b* is moved up while the thread loop r is progressively enlarged. In this instance, the upper thread n is held on the swelled protrusion 5*f* of the thread engaging portion 5 which is lower than the upper thread guide 5*g*, and is extended between the swelled protrusion 5*f* and the needle eye 17*a*. Thus the swelled protrusion 5*f* is adapted to enlarge the thread loop r on the rear side of the needle 17.

As the thread engaging portion 5 is further moved up, the threading hook 4*b* is moved up while the thread loop r is further enlarged. In this instance, the upper thread n on the swelled protrusion 5*f* of the thread engaging portion 5 is extended between the swelled protrusion 5*f*, which is lower than the upper thread guide 5*g*, and the needle eye 17*a*, the upper thread n being, however, moved down along the thread engaging portion 5 as the latter is moved up. The downward movement of the upper thread n may be smoothly performed because the swelled protrusion 5*f* is inclined lower toward in one direction. The upper thread n is disengaged from the thread engaging portion 5 at the lower end thereof while the thread loop r is enlarged to a predetermined size. Thus the thread engaging portion 5 is moved up to the upper inoperative position.

With the upper thread n being disengaged from the thread guide wall 5*a* at the lower end thereof, the upper thread is abruptly slackened between the needle eye 17*a* and the swelled protrusion 5*f* below the upper thread guide 5*g*. As the result, the thread loop r is disengaged from the threading hook 4*b*. Thus the threading operation is finished with a large thread loop r being formed on the rear side of the needle 17 as is extended through the needle eye 17*a*. Namely the size of the thread loop r is determined by the swelled protrusion 5*f* and the thread guide wall 5*a*, and the slack amount of the upper thread is determined by the distance between the needle eye 17*a* and the thread guide wall 5*a*. Such a slack amount will make it sure that the thread loop r is detached from the threading hook 4*b* and that the thread loop r is pulled out by the user from the needle eye 17*a*.

As is described hereinbefore, according to the invention, the threading member $A_1$ is provided with the swing center 4*c*, the threading hook 4*b* and the thread engaging portion 5 located between the swing center 4*c* and the threading hook 4*b* and is further provided with the upper guide 5*g* between the thread engaging portion 5 and the threading hook 4*b*. The upper thread n is guided from the front side of the upper guide 5*g* to the rear side of the thread engaging portion 5 and to the front side around the corner thereof, so that the upper thread n extended between the thread supply (not shown) and the upper guide 5*g* may be guided into the groove 20*b* of the thread holder 20 at the opening 20*a* thereof which is located rearward of the thread holder 20, while the thread engaging portion 5 is moved down. It is, therefore, apparent that the upper thread n may be easily and smoothly guided into engagement with the thread holder 20 in the process of threading operation while the operating section C is operated to move down the threading member $A_1$. Further it is apparent that the structure of the invention is designed to prevent the user from failing to guide the upper thread n into the thread holder 20. Further the thread holder 20 may be easily made of a plate member. Further the thread engaging portion 5 has the lower end side 5*e* extending progressively lower from the free end thereof to the swing center thereof. Further the thread engaging portion 5 has the swelled protrusion 5*f* extending along the lower end side 5*e* thereof. The lower end side 5*e* has one end vertically connected to the upper guide 5*g*. The upper thread n, therefore, may be vertically guided on the front side of the thread engaging portion 5 and pulled up around the lower end side 5*e* to the rear side and may be guided along the lower end side 5*e* into the upper guide 5*g*. The user is not required to directly take the upper thread n into the upper guide 5*g*.

Further, according to the invention, the upper thread n may be guided into the thread holder 20 at the rear side opening 20*a* thereof as the thread engaging portion 5 is simply moved down adjacent the thread holder 20 so as to pass the upper thread through the needle eye 17*a*. Precisely, the thread engaging portion 5 is moved down while the upper thread is held by the upper guide 5*g* and the thread engaging portion 5 including the swelled protrusion 5*f* and is extended laterally of the needle 17 between the thread engaging portion 5 and the hook guides of the threading hook 4*b* on the front side of the needle eye 17*a*.

Further according to the invention, the thread engaging portion 5 may be replaced by a vertically extended bar, provided that the bar is connected to the upper guide 5*g*. Such a bar may have a lower inclined portion for guiding the upper thread. In any event, such a vertically extended bar may vertically guide the upper thread n into the upper guide 5*g*. The user is not required to directly take the upper thread n into the upper guide 5*g*.

The invention thus described, it will be obvious that the same may be varied in many ways. Such variations are not to be regarded as a departure from the spirit and scope of the invention, and all such modifications are intended to be included within the scope of the following claims.

What is claimed is:

1. A threading device of sewing machine comprising:

a needle bar having a needle attached at the lower end thereof, said needle having a needle eye;

a needle bar support for supporting said needle bar such that said needle bar may be vertically movable;

a thread holder provided at the lower end of said needle bar support for holding an upper thread which is extended from a thread supply mounted on the sewing machine body;

a threading member having a swing center at one end thereof and swingingly movable around said swing center, said threading member having a threading hook provided at a free end thereof;

a threading shaft for holding said threading member at the lower end thereof;

an operating member for vertically moving and axially rotating said threading shaft to pass the upper thread through said needle eye;

said threading member including a thread engaging portion for holding the upper thread as is engaged thereto;

said thread holder being formed with an opening for receiving the upper thread threat while said threading member is moved down.

2. The threading device of sewing machine as defined in claim 1, wherein said thread engaging portion is adapted to hold the upper thread such that the upper thread may enter said opening of said thread holder into said thread holder while said threading member is moved down.

3. The threading device of sewing machine as defined in claim 1, wherein said threading member has an upper thread guide provided between said swing center and said threading hook, said upper thread guide being adapted to guide the upper thread from the front side thereof to the rear side of said thread engaging portion such that the upper thread may enter said opening of said thread holder into said thread holder while said threading member is moved down.

4. The threading device of sewing machine as defined in claim 1, wherein said thread engaging portion is generally a plate.

5. The threading device of sewing machine as defined in claim 1, wherein said thread engaging portion has a lower end side extending progressively lower from said swing center to said free end thereof.

6. A threading device of sewing machine comprising:

a needle bar having a needle attached to the lower end thereof, said needle having a needle eye;

a needle bar support for supporting said needle bar such that said needle bar may be vertically movable;

a threading shaft arranged rearward of said needle bar, said threading shaft be ing vertically movable and axially rotatable;

a threading member having a threading hook and mounted to the lower end of said threading shaft;

an operating member for vertically moving and axially rotating said threading shaft to pass an upper thread through said needle eye, the upper thread being extended from a thread supply mounted on the sewing machine body;

said threading member including a thread engaging portion having a vertically extended guide wall for guiding the upper thread, said guide wall having outer and inner lateral end sides, said outer lateral end side being located at the free end of said guide wall and said inner lateral end side being located in the neighborhood of the swing center of said guide wall, said guide wall further having a swelled protrusion formed on the rear surface thereof, said swelled protrusion extending progressively lower from said outer lateral end side to said inner lateral end side, wherein the upper thread is guided from said outer lateral end side to the rear surface of said guide wall and pulled out to the front surface of said guide wall around to said inner lateral end side, the upper thread being moved down at said inner lateral end side as said guide wall is moved up.

7. The threading device of sewing machine as defined in claim 6, wherein said swelled protrusion is adapted to guide the upper thread to release the same from said thread engaging portion as said threading shaft is moved up after the upper thread is passed through said needle eye.

8. The threading device of sewing machine as defined in claim 6, wherein said thread engaging portion has a lower end side which is extended progressively lower from said outer lateral end side to said inner lateral end side, and wherein said swelled protrusion is extended along the inclination of said lower end side of said thread engaging portion.

9. The threading device of sewing machine as defined in claim 6, wherein said swelled protrusion is progressively reduced from said outer lateral end side to said inner lateral end side.

10. A threading device of sewing machine comprising:

a needle bar having a needle attached at the lower end thereof, said needle having a needle eye;

a needle bar support for supporting said needle bar such that said needle bar may be vertically movable, said needle bar support being swingingly movable across a work feeding direction;

a threading shaft arranged rearward of said needle bar, said threading shaft having a threading member mounted to the lower end thereof and being vertically movable and axially rotatable, said threading member having one end mounted to the lower end of said threading shaft and having a free end having a threading hook provided thereon;

an operating member for vertically moving and axially rotating the threading shaft to pass the threading hook through the needle eye, thereby to pass a thread through the needle eye;

said threading member including a thread engaging portion provided between said one end of said threading member and said threading hook, and a hook guide provided adjacent said threading hook for guiding said threading hook toward said needle eye, said threading member further having an upper thread guide provided between said thread engaging portion and said hook guide and having a swelled protrusion formed as extending along the lower end side of said thread engaging portion on the rear side thereof, wherein the upper thread is guided from the front side of said upper thread guide to the rear side of said thread engaging portion and is guided to the front side of said thread engaging portion as extended around said thread engaging portion, wherein the thread engaging portion is moved down until the threading hook comes to the level of the needle eye and the upper thread is extended laterally of the needle on the front side thereof between said thread engaging portion and said hook guide, wherein said threading hook is passed through said needle eye from the rear side of the needle toward the user, wherein said threading hook is pulled back through the needle eye while catching the upper thread, wherein the upper thread is passed through said needle eye to the rear side of said needle in a form of thread loop while the upper thread on the rear side of said thread engaging portion is held by said swelled protrusion as the thread engaging portion is moved up, and wherein the thread loop is enlarged to a predetermined size as the thread engaging portion is moved up, the upper thread being then released from said swelled protrusion with an abrupt slack given to the upper thread extended between said thread engaging portion and said needle eye, said abrupt slack enabling said threading hook to disengage said thread loop.

11. The threading device of sewing machine as defined in claim 10, wherein said lower end side of said thread engaging portion is extended as is progressively lower from the free end of said thread engaging portion to said swing center thereof.

12. The threading device of sewing machine as defined in claim 10, wherein said swelled protrusion is progressively reduced from the free end of said thread engaging portion to said swing center thereof.

* * * * *